US006126041A

United States Patent [19]

DiTomasso et al.

[11] Patent Number: 6,126,041

[45] Date of Patent: Oct. 3, 2000

[54] LIQUID DISPENSER AND METHOD OF DISPENSING

[76] Inventors: Joseph DiTomasso; Beverly DiTomasso, both of 1 Winne Pl., Glenmont, N.Y. 12077

[21] Appl. No.: 09/398,631

[22] Filed: Sep. 17, 1999

Related U.S. Application Data

[63] Continuation-in-part of application No. 09/046,874, Mar. 24, 1998.

[51] Int. Cl.[7] ..... B65D 35/28

[52] U.S. Cl. ..... 222/95; 222/175; 224/148.1; 224/148.4; 224/148.6

[58] Field of Search ..... 222/95, 175; 224/148.1, 224/148.4, 148.6

[56] References Cited

U.S. PATENT DOCUMENTS

| | | | |
|---|---|---|---|
| 4,139,130 | 2/1979 | Glusker et al. | 222/175 |
| 4,351,526 | 9/1982 | Schwartz | 272/122 |
| 4,420,097 | 12/1983 | Motsenbocker | 222/131 |
| 4,702,473 | 10/1987 | Paquette | 272/117 |
| 4,703,927 | 11/1987 | Hanzlik | 272/122 |
| 4,712,794 | 12/1987 | Hall | 272/122 |
| 4,948,023 | 8/1990 | Tripp | 224/148 |
| 4,951,940 | 8/1990 | Vitello et al. | 224/128 |
| 4,988,097 | 1/1991 | Smith et al. | 272/119 |
| 5,050,870 | 9/1991 | Pollock | 272/119 |
| 5,060,833 | 10/1991 | Edison et al. | 224/148 |
| 5,104,016 | 4/1992 | Runkel | 224/148 |
| 5,282,557 | 2/1994 | McCook | 224/148 |
| 5,358,142 | 10/1994 | Holmes | 222/95 |
| 5,566,869 | 10/1996 | Katz | 224/148 |
| 5,571,260 | 11/1996 | Krug | 222/175 |
| 5,645,404 | 7/1997 | Zelenak | 222/175 |
| 5,957,347 | 9/1999 | White et al. | 224/148.1 |

FOREIGN PATENT DOCUMENTS

WO 98/05560 12/1998 WIPO .

*Primary Examiner*—Kevin Shaver
*Assistant Examiner*—Melvin A. Cartagena
*Attorney, Agent, or Firm*—Heslin & Rothenberg, P.C.

[57] ABSTRACT

A liquid dispenser securable about a user's limb for storing and dispensing a liquid and a method for dispensing the liquid. The dispenser comprises a sized flexible strap adapted to engage an outer surface of the limb. A flexible pouch is joined with the strap and includes a liquid impervious liner. A chamber is housed within the pouch where the liquid impervious liner surrounds the chamber and liquid can be stored within the chamber. A dispensing nipple extends through the pouch and is in fluid flow communication with the chamber. The nipple is operable between a closed position whereby the liquid is sealed within the chamber and an open position whereby the liquid can be communicated to or from the chamber. The dispenser includes an elongation characteristic wherein the dispenser can stretch more in a first direction than a different second direction as defined over a given area of the dispenser.

24 Claims, 9 Drawing Sheets

LIQUID DISPENSER AND METHOD OF DISPENSING

CROSS-REFERENCE TO RELATED APPLICATION

This application is a continuation-in-part of U.S. Ser. No. 09/046,874, filed Mar. 24, 1998, entitled Improved Liquid Dispenser and Method of Dispensing, which is incorporated fully herein by reference and which is being abandoned upon the granting of a filing date to this application.

FIELD OF THE INVENTION

The invention generally concerns the field of liquid dispensers and exercise devices incorporating same. More particularly, the invention concerns a liquid dispenser securable about the limb of a user for storing and dispensing a liquid as desired, and preferably automatically storing and dispensing the liquid.

BACKGROUND OF THE INVENTION

Various weight training and water dispensing devices exist in the art. However, these devices have several disadvantages. Often the devices are intended for only one purpose and are accordingly constructed as such which prevents their use in other ways. For example, some flexible liquid wrist mounted training devices exist in the art. Of these known devices, all have constructions directed to preventing the sloshing of liquid therein by providing various means internally of the liquid chamber. Further, such devices do not address how to maintain the liquid training device in a secure position about the limb of the user when dispensing liquid during use, preferably without having to adjust the positioning of the whole device. Still further, such devices are not designed to dispense liquid during continuous use, nor dispense liquid automatically.

Other devices exist that are more directed to dispensing a liquid during use of the device. Again, however, these devices have several short comings. Often, these devices are hand held which has obvious disadvantages for use during exercising or if one has little hand strength. Also, these devices are not designed to dispense liquid automatically. Still further, these devices do not address how to continuously and automatically maintain the liquid in a secure position within the device, and also to prevent undesirable sloshing when dispensing liquid during use and after the device is less than completely full to capacity with the liquid.

Accordingly, a liquid dispenser is needed that overcomes at least some of the disadvantages of the prior weight training and water dispensing devices. In particular, a dispenser is needed that is adaptable for use as an exercise device and also enables a drinkable liquid to be dispensed during use, and preferably automatically. Further, a dispenser is needed that maintains itself in a comfortable, secure position about the limb of the user when dispensing liquid during use, preferably without having to adjust the positioning of the whole device. Still further, a dispenser is needed whereby the liquid within the dispenser is continuously and automatically maintained in a secure position within the dispenser to, preferably, prevent undesirable sloshing when dispensing liquid during use and after the dispenser is less than completely full to capacity with the liquid.

The devices disclosed in the prior patents and known to us do not offer the flexibility and inventive features of our liquid dispenser and method of dispensing a liquid. As will be described in greater detail hereinafter, the features of the present invention differ from those previously proposed and overcome at least some disadvantages of the prior devices.

SUMMARY OF THE INVENTION

According to the present invention there is provided a liquid dispenser securable about a user's limb for storing and dispensing a liquid. The dispenser comprises a sized flexible strap adapted to engage an outer surface of the limb. A flexible pouch is joined with the strap and includes a liquid impervious liner. A chamber is housed within the pouch where the liquid impervious liner surrounds the chamber and liquid can be stored within the chamber. A dispensing nipple extends through the pouch and is in fluid flow communication with the chamber. The nipple is operable between a closed position whereby the liquid is sealed within the chamber and an open position whereby the liquid can be communicated to and from the chamber. The dispenser also has an elongation characteristic which enhances its operation and comfort for the user.

Other features of the invention concern a method for dispensing a liquid from a liquid dispenser locatable about a limb of a user. The method preferably comprises the steps of: creating a substantially continuous positive pressure within the chamber; dispensing the liquid from the chamber by opening the nipple, wherein the pressure within the chamber automatically dispenses the liquid when the nipple is open; and, stretching the dispenser more in a first direction than in a second direction to enhance operation and comfort to the user.

According to other features of the invention there is also provided a dispenser structure and method that, preferably, can maintain a substantially continuous positive pressure within the chamber, can be constructed with materials having particular operational characteristics, can be particularly configured to enhance use and comfort of the same and can serve dual thirst relief and exercise training purposes.

In accordance with the following, it is an advantage of the present invention to store and dispense a liquid from a dispenser that is adaptable for use as an exercise device and also enables a drinkable liquid to be dispensed during use, and preferably automatically.

A further advantage is to employ an elongation characteristic for one or more elements of the dispenser whereby the operation and comfort of the invention are enhanced.

A still further advantage is to store and dispense a liquid in and from a dispenser that keeps the user's hands free and that can be used by people of all ages, in exercise and non-exercise environments alike.

DESCRIPTION OF THE DRAWINGS

Other features and advantages of the invention will become more readily apparent upon reference to the following description when taken in conjunction with the accompanying drawings, which drawings illustrate several embodiments of the invention.

DETAILED DESCRIPTION OF THE PREFERRED EMBODIMENT

Figure 1:
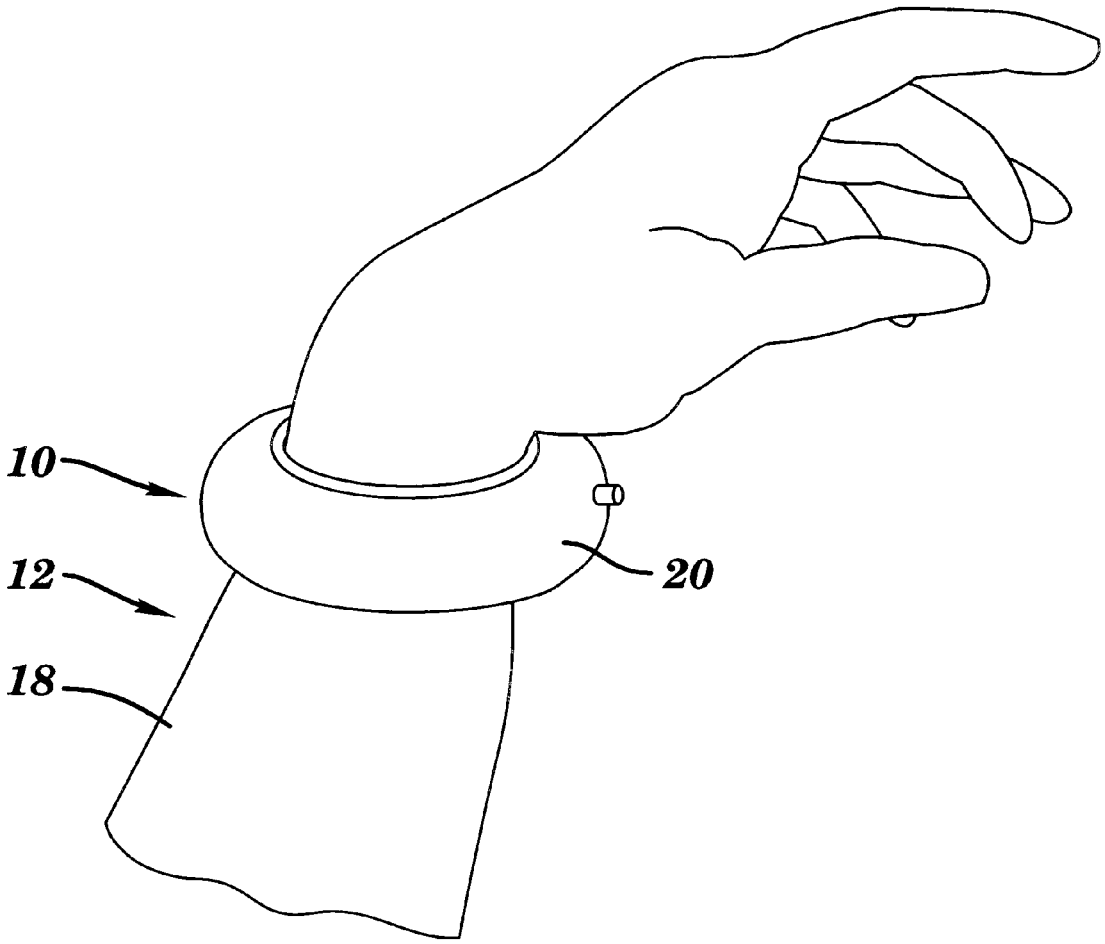
FIG. 1 is a perspective view of an embodiment of a dispenser secured about a user's wrist and substantially filled with a liquid.
Figure 2:
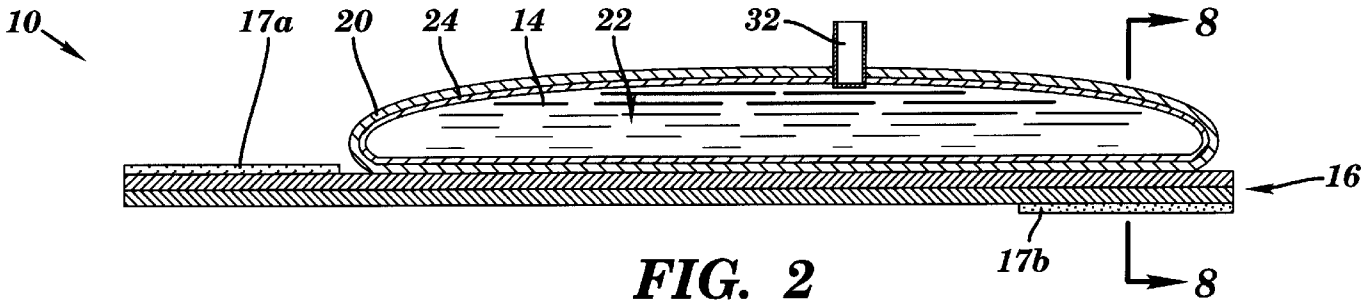
FIG. 2 is partial cross-sectional side view of the dispenser of FIG. 1, here laid flat.
Figure 3:
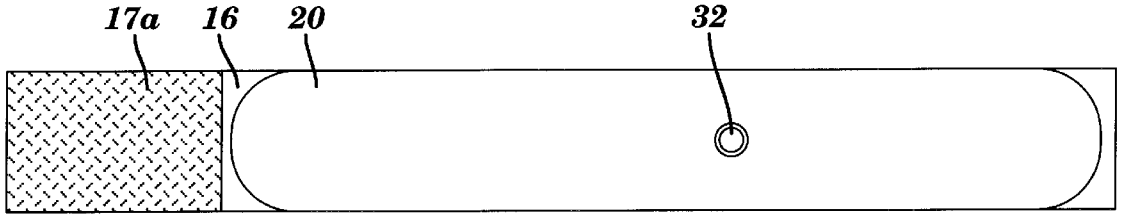
FIG. 3 is top view of the dispenser of FIG. 1, here laid flat.
Figure 4:
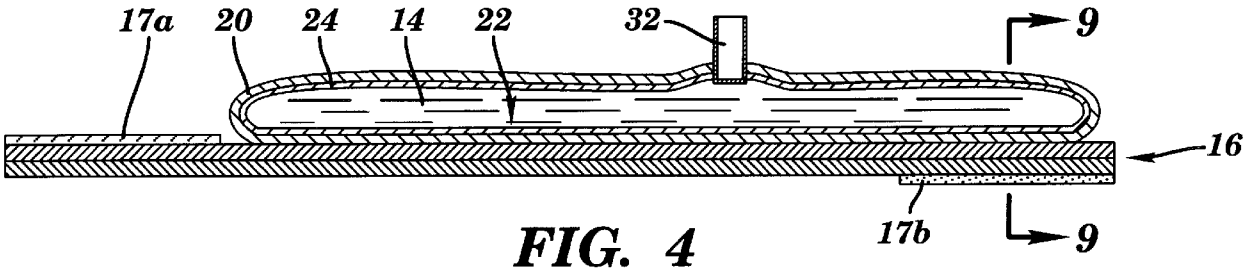
FIG. 4 is partial cross-sectional side view of the dispenser of FIG. 1, here laid flat and only partially filled with the liquid.
Figure 5:
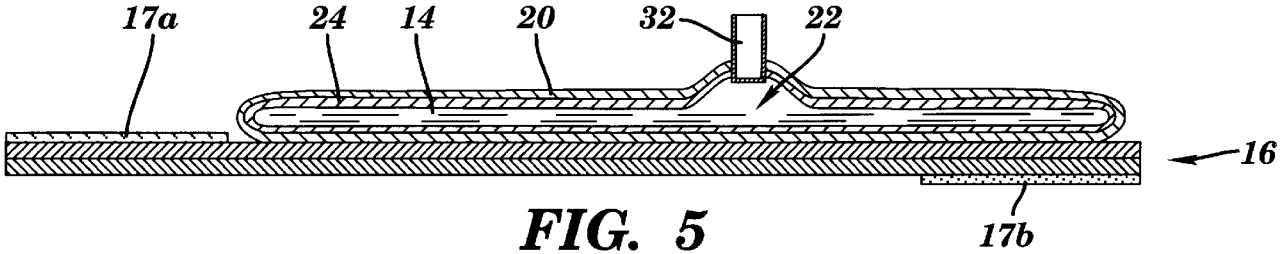
FIG. 5 is partial cross-sectional side view of the dispenser of FIG. 1, here laid flat and nearly empty of the liquid.

Referring to the drawings, and particularly FIGS. 1–7 and 16–17 for example, the invention comprises a liquid dispenser 10 securable about a user's limb 12 for storing and dispensing a liquid 14. The liquid may comprise any flowable liquid but is preferably water, a sports drink or the like which the user desires to store at a first time and then dispense for drinking at a later time.

Figure 16:
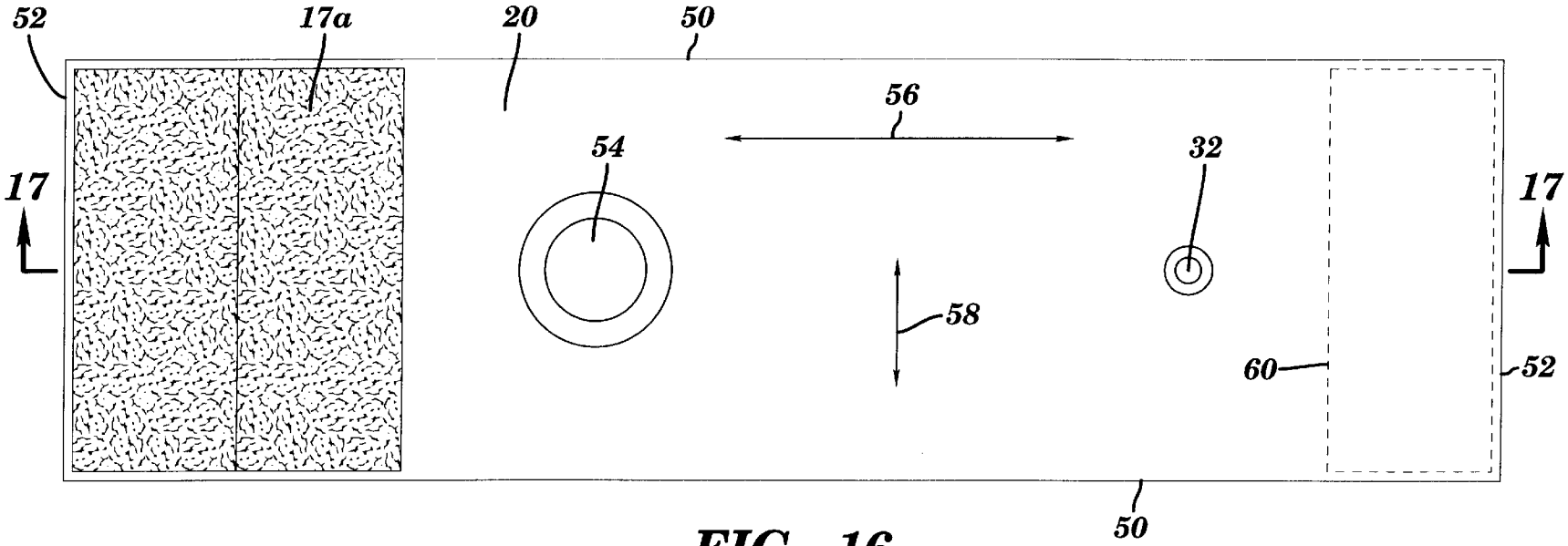
FIG. 16 is a top view of another embodiment of a dispenser of the present invention.

The liquid dispenser 10 includes a sized flexible strap 16 adapted to engage an outer surface 18 of the limb 12. Cooperating VELCRO™ type hook and loop pads 17*a* and 17*b* may be used as the means for securing the dispenser 10 about the user's limb. For example, the pads 17*a* and 17*b* may be attached to the strap 16 by any conventional means, and an adhesive backed pad could be used. As seen in FIG. 16, a stitching 60 may also, or alternatively, be used to attach one or both pads 17*a* and 17*b*.

Although the strap 16 is flexible, it can be made of a non-stretchy/non-elastic material, such as a conventional nylon-type strap that does not substantially increase in length when stretched. However, a stretchy/elastic material could also be utilized, but as such, the desirable feature of a more universal type strap which is possible with a non-stretchy/non-elastic material may be compromised. In spite of this potentially compromised feature though, such a device with a stretchy/elastic material strap is within the scope of the invention and may better serve other features of the invention.

Figure 11:
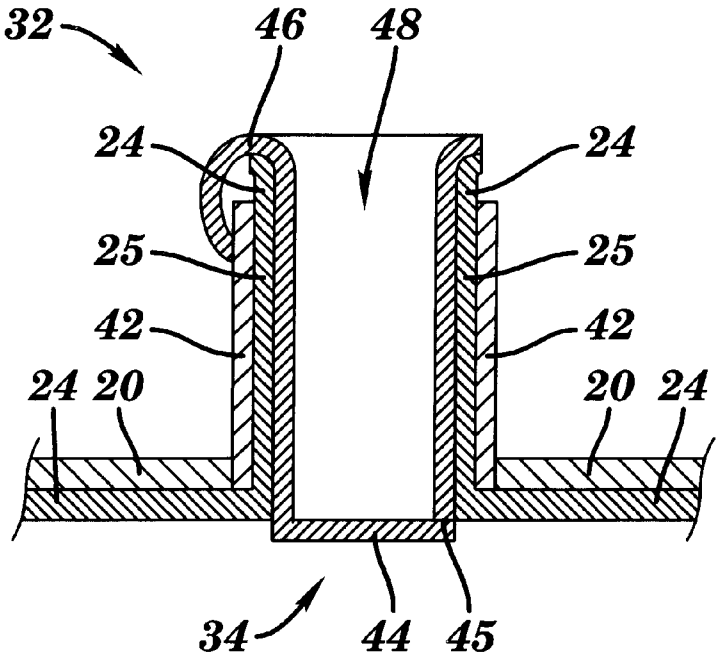
FIG. 11 is an enlarged cross-sectional side view of an alternate nipple in a closed position for the various embodiments of dispensers of the invention.
Figure 10:
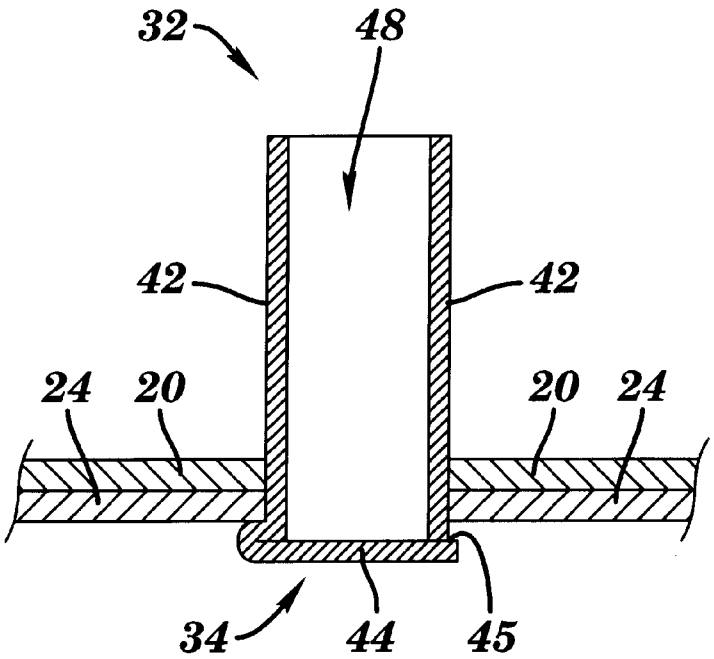
FIG. 10 is an enlarged cross-sectional side view of a nipple in a closed position for the various embodiments of dispensers of the invention.
Figure 13:
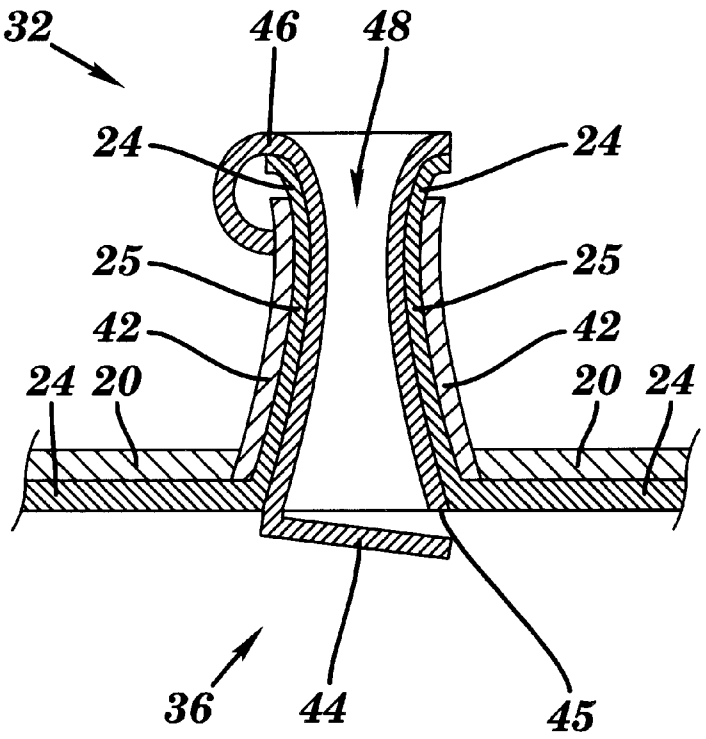
FIG. 13 is an enlarged cross-sectional side view of the nipple of FIG. 11, here in an open position.
Figure 12:
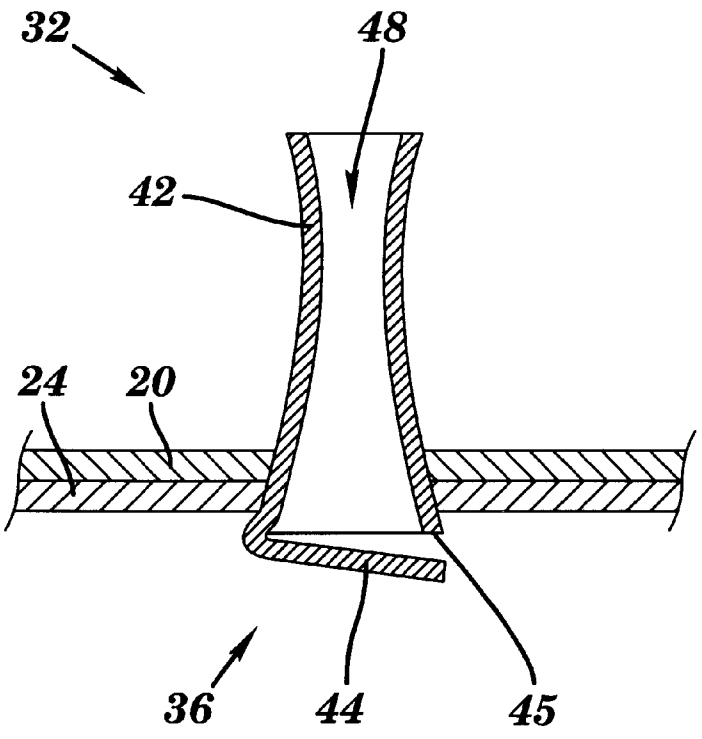
FIG. 12 is an enlarged cross-sectional side view of the nipple of FIG. 10, here in an open position.
Figure 14:
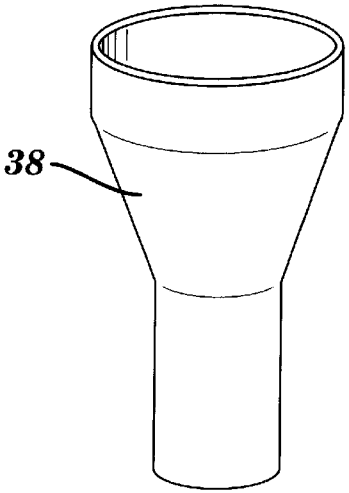
FIG. 14 is a perspective view of a filling nozzle of the invention.

A flexible pouch 20 is joined with the strap 16. A chamber 22 is housed within the pouch. A liquid impervious liner 24 surrounds the chamber and enables the liquid to be stored within the chamber without leaking out. A dispensing nipple 32 extends through the pouch and is in fluid flow communication with the chamber. The nipple is operable between a closed position 34 (FIGS. 10 and 11) and an open position 36 (FIGS. 12 and 13). The liquid is substantially sealed within the chamber when the nipple is in the closed position (FIGS. 10 and 11). However, liquid can be communicated to and from the chamber when the nipple is in the open position (FIGS. 12 and 13). The open position comprises any range of positions where a sealing flap 44 is not engaged against a sealing seat 45. Liquid is preferably communicated to the chamber via a filling nozzle 38, however, other means may be used as desired. The nozzle is preferably sized at one end to be large enough to fit over and sealingly engage a liquid source (e.g., a conventional faucet tap, a beverage bottle, etc.) and at a second end to be sized to sealingly fit within a communicating channel 48 of the nipple. In this way, the nozzle can supply a flow of pressurized liquid to the chamber, for reasons hereinafter discussed.

The pouch is preferably constructed of a stretchy/elastic material. Depending on the features desired as hereinafter discussed, the pouch may comprise a material like that of an ACE™ bandage, a rubber or synthetic rubber material, a composite material having the desired stretchy/elastic characteristic or the like. For example, a polyurethane control stretch fabric known as style R0200262, manufactured by Highland Industries, Inc. of Framingham, Mass., produces good results. Additionally, as desired, favorable results are obtained when such control stretch fabric has the liquid impervious layer of polyurethane at a thickness of about 5 mils, with the polyurethane inner layer joined to jersey knit. The polyurethane may also be a polyester polyurethane and the jersey knit may be nylon based fabric (however, any similar fabric may be used such as rayon, polypropylene, synthetic fibers, etc.). In particular, the pouch preferably has the ability to expand in size, and the chamber 22 therein in volume, in response to receiving the liquid and then automatically shrink in size, and volume, when the liquid is dispensed whereby the pouch can return to its pre-liquid containing condition or at rest position when all liquid is dispensed. In this way, such a pouch can supply a force exerted on a periphery of the chamber in a substantially radial inward direction 30 whenever the pouch is stretched from its at rest position and the dispenser is secured about the user's limb.

Such a construction can also provide a pouch wherein the force maintains a substantially continuous positive pressure, and preferably a pressure at least as great as atmospheric pressure, within the chamber whenever the pouch is stretched from its at rest position. In this way, liquid can be automatically dispensed from the chamber whenever the nipple is in the open position and there is liquid within the chamber. If the pressure within the chamber is less than atmospheric, the invention can still be practiced when the nipple is open. However, one must exert a pressure on the pouch to thereby create a greater positive pressure within the chamber, suck the liquid from the chamber, or use some similar means to dispense the liquid.

In another embodiment of the invention, the desired force may be exerted on the pouch by use of a stretchy/elastic strap 16 with a non-stretchy/non-elastic pouch or a stretchy/elastic pouch. For a dispenser constructed in this way, the strap will likely have to be particularly sized to particular lengths in combination with the stretch and elasticity characteristics of the pouch. For example, the stretch control fabric of Highland Industries, Inc. may be employed to construct the strap 16, the pouch 20, the liner 24 or a combination of one or more of these, as seen throughout the figures and particularly FIGS. 16 and 17. Similarly, the inventors have discovered that providing one or more of the strap 16, the pouch 20, or the liner 24 with an elongation characteristic aids the dispensing features of the invention and helps the dispenser 10 better conform, comfortably, as a whole unit to the user's limb.

Figure 18:
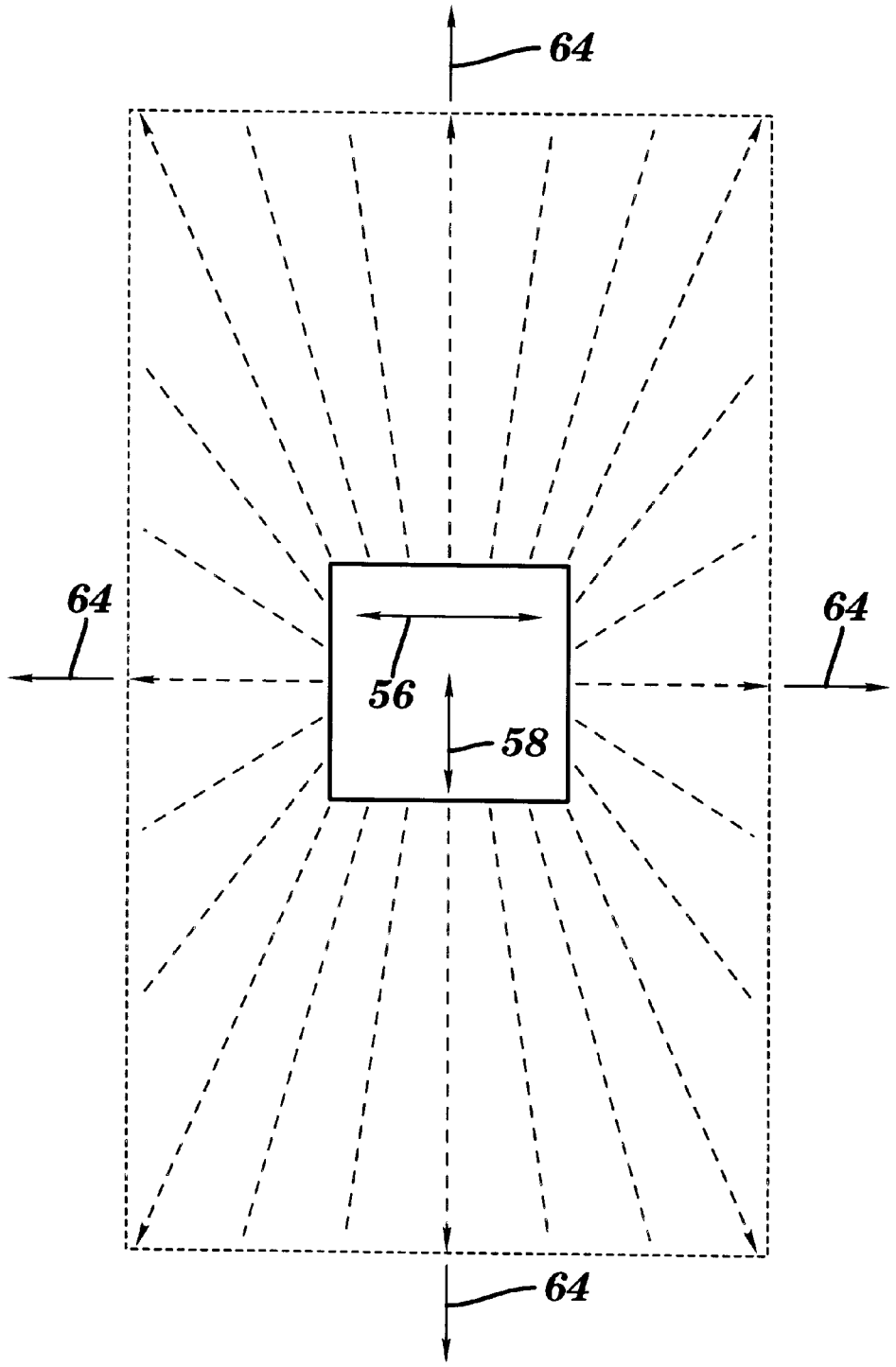
FIG. 18 is a schematic representation of an element of the invention having a particular elongation characteristic.

In this regard, the elongation characteristic is defined by applying an equal force to a square area of a portion of the material used to construct a particular element of the invention (e.g., strap 16, pouch 20 or liner 24). That is, the force is applied in a first direction, e.g., in a widthwise direction 58 (FIG. 16), and a particular elongation or stretch ratio is determined based on the non-stretched length compared to the stretched length for the first direction of a square area (e.g., one inch by one inch ) of the element. Similarly, the same force is applied in a second direction, e.g., a lengthwise direction 56 (FIG. 16), and a particular elongation or stretch ratio is determined based on the non-stretched length compared to the stretched length for the second direction of a square area (e.g., one inch by one inch) of the element. For example, FIG. 18 schematically depicts an area of a portion of an element of the invention (e.g. strap 16, pouch 20 or liner 24) having such an elongation characteristic. In solid lines is the area of a portion of the element (and here a square area for explanatory purposes but where it is understood that other geometric shapes could be used as long as the two directions of stretch are different) in the non-stretched, at rest position. In dotted lines is the stretched positioning of the area of the portion of the element, here having a greater stretch in the first direction (e.g. widthwise direction 58) versus the second direction (e.g. lengthwise direction 56), when stretched by an equal force 64 in different directions.

The inventors have also discovered that the elongation characteristic produces favorable results when the first direction is about perpendicular to the second direction, e.g., directions 58 and 56 in FIG. 16. Further, the inventors have discovered that, preferably, the first direction is the widthwise direction 58 elongation characteristic and it is greater than the second direction elongation characteristic which is, preferably, in the lengthwise direction 56. The inventors have further discovered that the elongation characteristic produces particularly excellent results when the elongation characteristic comprises stretch in the first direction, e.g., in the widthwise direction, in a range of about 1:2 to about 1:4 and stretch in the second direction, e.g., the lengthwise direction, in a range of about 1:1 to about 1:2. In practice, the elongation characteristic enhances the dispensing of liquid from the chamber by maintaining a more constant pressure gradient. Also, the comfort of the device on the user's limb is increased because the elongation characteristic aids in better contouring the dispenser to the limb, e.g., particularly when at least the pouch 20 has such an elongation characteristic.

Concerning the chamber, it preferably comprises a single chamber, as depicted. With a single chamber, when dispensing liquid the radial pressure exerted by the pouch will be substantially uniform, the pouch will shrink at a substantially uniform rate and liquid can be readily dispensed more uniformly. Additionally, with the single chamber the remaining liquid can be more securely maintained about the user's wrist although the volume within the chamber has decreased. Further in this regard, the chamber preferably has a substantially continuously smooth chamber wall, as opposed to a wall with ridges, sub-chambers or other protrusions extending inwardly from the chamber wall. Again, this further assists in the more uniform dispensing of liquid and to more securely maintain the dispenser 10 about the user's wrist although the volume within the chamber has decreased. In summary, these preferred features contribute to providing a stable and more secure liquid mass about the user's wrist even as the volume changes, and without having to adjust the strap 16 to securely maintain the dispenser about the user's wrist, in some embodiments.

Figure 17:
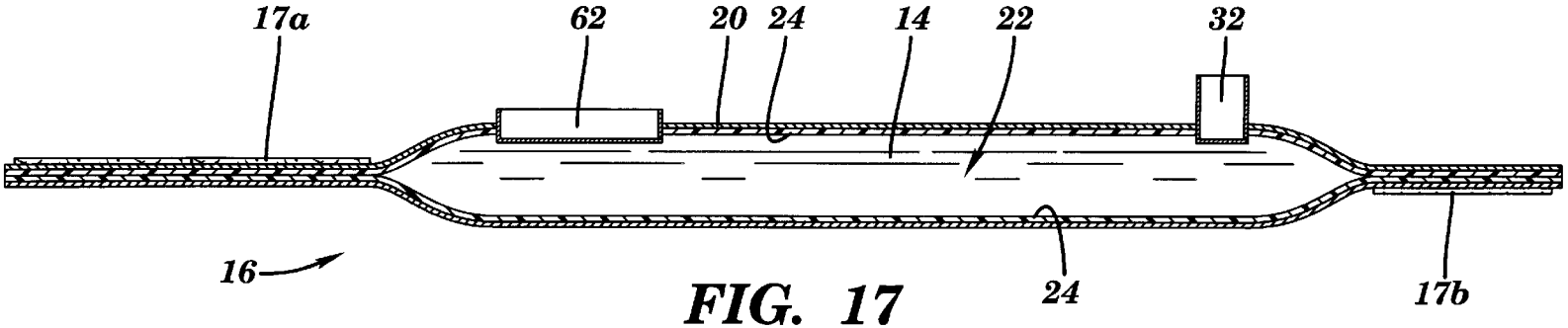
FIG. 17 is a cross-sectional side view of the dispenser of FIG. 16, partially filled with a liquid and having a dispensing nipple and a filling closure.

The pouch may be joined directly with the strap 16, such as through conventional sonic or thermal weld processes, a stitched relationship, or similar type process or relationship as known in the art. For example, as depicted in FIGS. 16 and 17, the pouch 20 is joined to or with the strap 16 even more integrally than in the other embodiments. Here, in a preferred construction, the strap and pouch share construction materials though they still separately define the elements of the invention. Through a radio frequency welding (RFW) process, the opposed lengthwise sides 50 and the widthwise ends 52 are joined together. In this regard, the polyurethane control stretch fabric of Highland Industries, Inc. produces good results. Further, although not fully depicted, the chamber 22 may be bounded on all sides by about a ⅜ inch border where the polyurethane control stretch fabric is joined togehter by the RFW process. Also, as depicted, the widthwise ends 52 may be joined by the RFW process from their tips inward until the chamber is reached.

Figure 6:
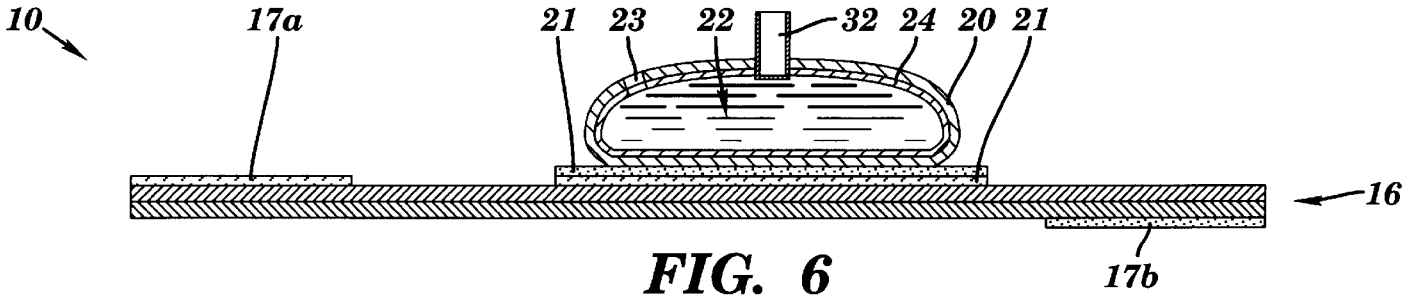
FIG. 6 is partial cross-sectional side view of another embodiment of a dispenser removably secured to a strap which is securable about a user's wrist and is here substantially filled with a liquid and laid flat.

Alternatively, or additionally, the pouch may be joined indirectly with the strap such as by conventional glue bonds or some other conventional adhesive-type material positioned between these two to join them together. Yet further, in an alternative embodiment of the invention, as depicted in FIGS. 6 and 7, the pouch can be removably attached to the strap, such as by a conventional pair of cooperating VELCRO™ layers 21.

The pouch and the liner may be unified in a homogeneous or composite material. In such a case, the liquid impervious liner 24 may merely be an inner surface of the pouch 20, wherein the whole pouch is liquid impervious and also has the desired flexible and/or elastic characteristics. Additionally, the pouch and the liner may be integrally connected whereby the liner and the pouch comprise distinct layers relative to one another and are formed by conventional means, e.g., the polyurethane control stretch fabric of Highland Industries, Inc. Still further, the pouch and the liner may not be connected in any permanent way, but rather, the liner may comprise a separate layer that provides the liquid impervious characteristics and the pouch provides the stretchy/elastic characteristics as desired. In each case, the pouch, the liner and a combination of the pouch and the liner could be disposable and in replaceable communication with the strap and the other respective members.

Figure 7:
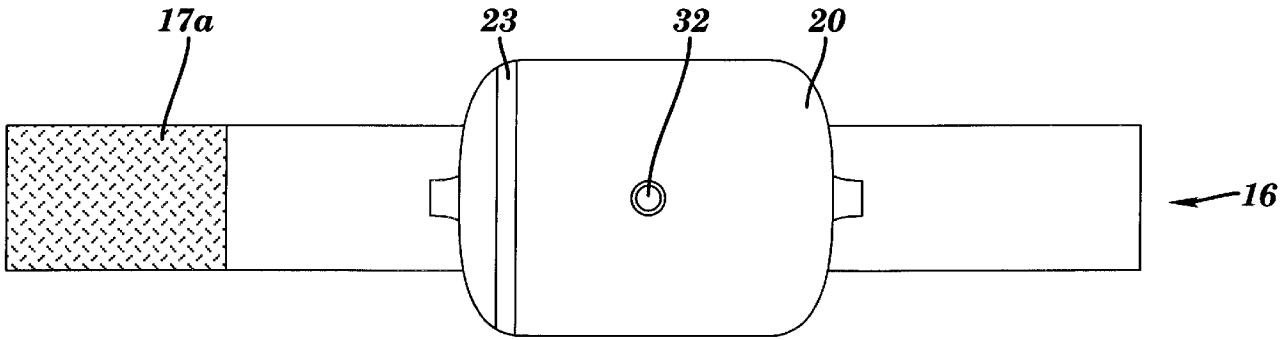
FIG. 7 is top view of the dispenser of FIG. 6.

As shown in FIG. 7, a sealable opening 23 of a VELCRO™ type closure material is provided so that the liner alone can be separated from the pouch and the strap and a separate liner inserted therein. The construction of the pouch and the liner will then determine the way that the nipple is connected with the pouch and/or the liner. As shown in FIGS. 10 and 12, the liner and the pouch are of either a homogeneous, composite or integrally connected construction, and the pouch may be removably or fixedly attaching with the strap. In such a case, a nipple outer portion 42 will preferably be integrally connected with both the pouch and the liner, as shown, by appropriate means such as forming integrally, bonding, gluing, friction fitting, thermal or sonic weld process, a combination of these or another similar means. For example, a nipple known as a Halkey Roberts "pop it" valve, #320AC, sold by the Halkey Roberts Company of Tampa, Fla., may be used. Such a valve is also disclosed in U.S. Pat. No. 2,859,932 which is incorporated herein by reference. In this regard, although not shown clearly, the valve can be joined to the pouch by the RFW process described earlier. Liquid can be communicated via the nipple through the communicating passageway 48 located internally of the outer portion. Also, as seen in FIGS. 16 and 17, a filling closure 54 may be used. The closure 54 has a fitted relationship with the closure seat 62. For example, the closure known as a Carmo fill/drain #3-675, made by the Carmo Company of Sweden, may be used. This closure can be attached to the pouch by the RFW process also.

Alternatively, as shown in FIGS. 11 and 13, the liner is removable from the pouch, and the pouch may be removably or fixedly attached with the strap. In such a case, the nipple outer portion 42 will preferably be integrally connected with only the pouch, as shown, by appropriate means such as forming integrally, bonding, gluing, friction fitting, thermal or sonic weld process, a combination of these or another similar means. The liner will have a nipple neck 25 that extends through the outer portion 42. The nipple will further include an inner portion 46 which is insertable into the outer portion 42 and which sandwiches the nipple neck 25 between the outer portion 42 and the inner portion 46. In this embodiment, liquid can be communicated via the nipple through the communicating passageway 48 located internally of the inner portion.

Figure 15:
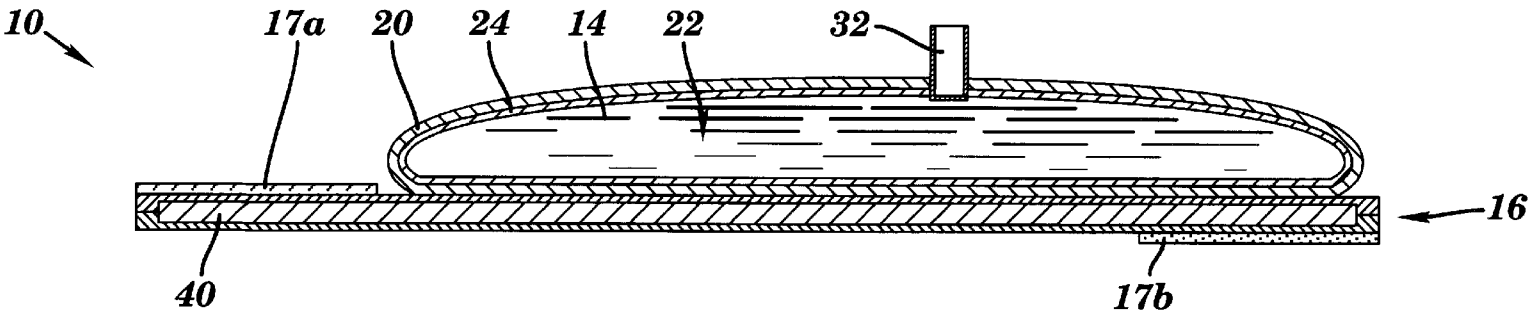
FIG. 15 is a partial cross-sectional side view of another embodiment of a dispenser similar to that of FIG. 1, here shown laid flat and including a weight member connectable with the strap.

Yet a further feature the invention may include is a weight member 40 attachable with the strap (FIG. 15). The weight is preferably sized and configured to be slightly smaller than the strap in length and width. In this way, although attaching may be by any conventional means, excellent results are contemplated when the means comprises inserting the weight in a pocket within the strap. In this regard, isometric advantages may be better utilized.

In operation, the invention may function as follows. First, some amount of liquid is put into the chamber using the filling nozzle. This, in turn, creates a substantially continuous positive pressure within the chamber because of the elastic characteristic of the pouch and it being elastically tensioned due to the presence of the liquid. That is, preferably the elastic tensioning creates a substantially radial inward force on a periphery of the chamber when the dispenser is positioned around a user's limb. Next, the liquid is dispensed from the chamber by opening the nipple, wherein the pressure within the chamber preferably automatically causes the liquid to be dispensed when the nipple is open, though it may be necessary to provide an external force as well (e.g., squeezing pouch or sucking on nipple).

Figure 9:
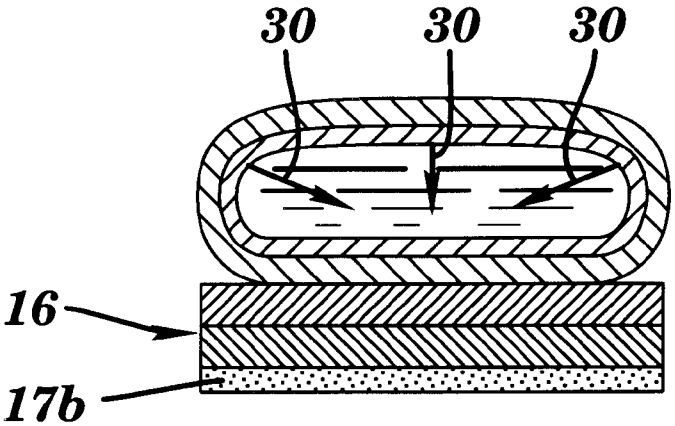
FIG. 9 is a cross-sectional end view of the dispenser of FIG. 4, taken along the line 9—9.
Figure 8:
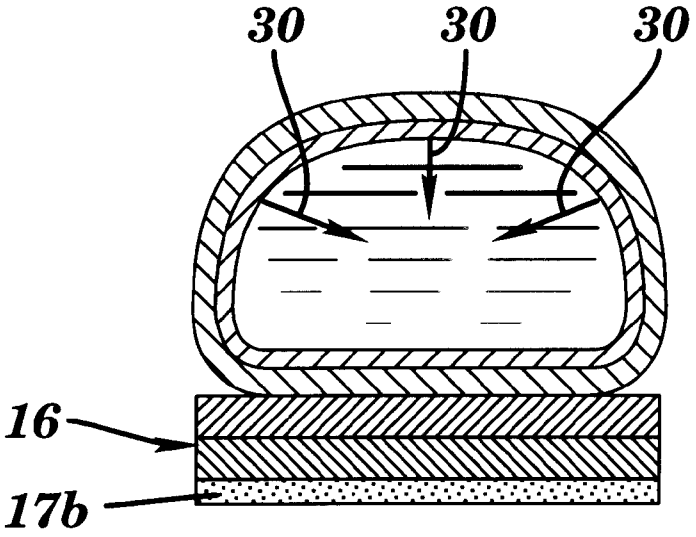
FIG. 8 is a cross-sectional end view of the dispenser of FIG. 2, taken along the line 8—8.

Although not required, it is preferred that the chamber comprise the single chamber wherein a cross-sectional diameter of the chamber is reduced at a substantially uniform rate when dispensing the liquid, see FIGS. 8 to 9 for example. Also, similar to that discussed above, this feature further contributes to providing a more stable and secure liquid mass even as the volume changes, without having to adjust the strap 16, i.e., automatically maintaining the liquid dispenser in a secure position about the limb of the user when dispensing liquid, in some embodiments.

The step of dispensing preferably comprises partially pinching together a portion of the nipple, as shown in FIGS. 12 and 13, although this is not necessary for the Halkey Roberts valve. In this way, the sealing flap 44, hinged at a portion of its edge, is forced away from a sealing seat 45 and liquid can exit the chamber through the gap. To put liquid into the chamber, pinching is not required because the liquid coming into the chamber under pressure will force flap 44 out of the way. Liquid is sealed in the chamber by a natural biasing tendency of the sealing flap to remain seated against the sealing seat when in its rest position. Further, when liquid is in the chamber the force of the liquid under pressure therein further acts to press the sealing flap against the sealing seat to thereby seal the chamber. As seen in FIGS. 16 and 17, the nipple 32 may be used to dispense liquid and the closure 54 may be used to fill the chamber 22.

During development of the invention, the inventors have discovered particular dimensions that may be employed to practice the invention, namely, as seen in FIGS. 16 and 17. It should be clearly understood that ultimately, these may depend on intended use for the product of the invention and thus no limitations can be placed on the invention in this regard. For example, a length of 14 inches and a width of 4½ inches may be employed for the dispenser 10 finished dimensions. A chamber length of 9¼ inches and width of 3½ inches may be employed for finished dimensions. Then, 2 inch wide strips of VELCRO™ may be used for pads 17*a* and 17*b* and 17*a* may comprise two 2 inch pads side by side. A ¼ inch border of RFW joined material may extend around the circumference of the dispenser, and a stitching may be used in combination with the border to provide added strength to the joined edges 50 and 52.

As various possible embodiments may be made in the above invention for use for different purposes and as various changes might be made in the embodiments above set forth, it is understood that all of the above matters here set forth or shown in the accompanying drawings are to be interpreted as illustrative and not in a limiting sense.

We claim:

1. A liquid dispenser securable about a user's limb for storing and dispensing a liquid, comprising:

a sized flexible strap adapted to engage an outer surface of the limb;

a flexible pouch joined with the strap and including a liquid impervious liner;

a chamber housed within the pouch, the liquid impervious liner surrounding the chamber wherein the liquid can be stored within the chamber;

a dispensing nipple extending through the pouch and in fluid flow communication with the chamber, the nipple being operable between a closed position wherein the liquid is sealed within the chamber and an open position wherein the liquid can be communicated to and from the chamber when the nipple is in the open position; and, wherein at least one of the members from the group consisting of the sized flexible strap, the flexible pouch and the liquid impervious liner has an elongation characteristic such that a force applied equally in different first and second directions to a square portion of the member causes the square portion of the member to stretch a greater amount in the first direction than in the second direction.

2. The liquid dispenser of claim 1, further comprising means for elastically tensioning the pouch wherein a force is exerted on a periphery of the chamber in a substantially radially inward direction, when the dispenser is secured about the user's limb.

3. The liquid dispenser of claim 2, wherein the force maintains a substantially continuous positive pressure within the chamber.

4. The liquid dispenser of claim 3, wherein the positive pressure is at least as great as atmospheric pressure.

5. The liquid dispenser of claim 2, wherein the means comprises the pouch having an elastic characteristic.

6. The liquid dispenser of claim 1, wherein the chamber comprises a single chamber having a substantially continuously smooth chamber wall.

7. The liquid dispenser of claim 1, wherein the pouch and the liner are integrally connected.

8. The liquid dispenser of claim 1, further comprising the pouch surrounding the liner and wherein a member from a group consisting of the pouch, the liner and a combination of the pouch and the liner are disposable and in replaceable communication with the strap.

9. The liquid dispenser of claim 1, in combination with a filling nozzle engagable with the nipple for communicating a supply of the liquid into the chamber.

10. The liquid dispenser of claim 1, in combination with a weight member connectable with the strap.

11. The liquid dispenser of claim 1, wherein the elongation characteristic comprises stretch in the first direction in a range of about 1:2 to about 1:4 and stretch in the second direction in a range of about 1:1 to about 1:2.

12. The liquid dispenser of claim 1, wherein the first and second directions are about perpendicular to one another.

13. The liquid dispenser of claim 12, wherein the first direction is a widthwise direction and the second direction is a lengthwise direction.

14. The liquid dispenser of claim 11, wherein the first direction is a widthwise direction and the second direction is a lengthwise direction and the widthwise direction is about perpendicular to the lengthwise direction.

15. The liquid dispenser of claim 1, wherein at least two of the members from the group consisting of the sized flexible strap, the flexible pouch and the liquid impervious liner have different elongation characteristics.

16. A method for dispensing a liquid from a liquid dispenser locatable about a limb of a user, the liquid dispenser including a chamber and an operable nipple in liquid flow communication with the chamber, the method comprising:

creating a substantially continuous positive pressure within the chamber;

dispensing the liquid from the chamber by opening the nipple, wherein the pressure within the chamber automatically dispenses the liquid when the nipple is open; and, stretching the liquid dispenser more in a first direction than in a second direction for a square portion of the liquid dispenser when the dispenser is secured about the limb of the user and a force is applied equally in the first and second directions to the square portion and where the first and second directions are different.

17. The method of claim 16, wherein the liquid dispenser further includes a flexible strap adapted to engage at least a portion of a circumference of the limb and wherein a flexible pouch is joined to the strap and houses the chamber.

18. The method of claim 16, wherein the creating step comprises exerting a substantially radially inward force on a periphery of the chamber when the dispenser is secured about the user's limbs.

19. The method of claim 18, wherein the creating step is performed substantially continuously.

20. The method of claim 18, wherein the chamber has a substantially curved chamber wall.

21. The method of claim 19, wherein the pressure within the chamber is greater than atmospheric pressure.

22. The method of claim 19, wherein the chamber comprises a single chamber and wherein a cross-sectional diameter of the chamber is reduced at a substantially uniform rate when dispensing the liquid.

23. The method of claim 16, further comprising continuously automatically maintaining the liquid dispenser in a position about the limb of the user when dispensing liquid.

24. The method of claim 16, wherein the stretching step comprises stretching the portion of the liquid dispenser in the first direction in a range of about 1:2 to about 1:4 and in the second direction in a range of about 1:1 to about 1:2.

* * * * *